United States Patent [19]

Reese

[11] 3,998,404

[45] Dec. 21, 1976

[54] TRANSVERSE MECHANISM FOR WINDING FIBER GLASS

[75] Inventor: Walter J. Reese, North Huntington, Pa.

[73] Assignee: PPG Industries, Inc., Pittsburgh, Pa.

[22] Filed: Sept. 25, 1975

[21] Appl. No.: 616,715

[52] U.S. Cl. ..... 242/158.3; 65/2; 65/11 W; 242/158.4 R; 242/158.5

[51] Int. Cl.[2] ..... C03B 37/02; B65H 57/28

[58] Field of Search ..... 65/2, 3, 11 W; 242/18 G, 158.3, 158.4 R, 158.5; 28/54

[56] References Cited

UNITED STATES PATENTS

| | | | |
|---|---|---|---|
| 1,954,713 | 4/1934 | Powell | 242/158.3 X |
| 2,149,536 | 3/1939 | Moncrieff et al. | 28/54 X |
| 2,494,003 | 1/1950 | Russ | 242/158.3 |
| 3,547,361 | 12/1970 | Klink | 242/18 G |
| 3,653,860 | 4/1972 | Smith et al. | 65/11 W |
| 3,819,122 | 6/1974 | Genson | 242/18 G X |
| 3,918,947 | 11/1975 | Maaghul et al. | 65/11 W X |

*Primary Examiner*—Robert L. Lindsay, Jr.
*Attorney, Agent, or Firm*—Alan T. McDonald; John E. Curley

[57] ABSTRACT

A new and improved process for winding fiber glass strand from a glass fiber forming bushing is described in which glass fibers are drawn from a bushing by attenuation at high glass pull rates. The fibers have a suitable binder applied to them and are partially dried as they are attenuated. The partially dried filaments are then gathered into a strand and the strand is then collected on a collection surface carried on a high speed winder. The winder is provided with a novel traversing guide system which has the cam roller and guide eye positioned on the same side of the vehicle guide thereby reducing the bending moments created by the traverse cam and strand tension by forcing them to act in opposite directions. Lateral guidance of the vehicle is provided by a high speed die set ball bushing running on a hardened steel shaft.

8 Claims, 3 Drawing Figures

TRANSVERSE MECHANISM FOR WINDING FIBER GLASS

BACKGROUND OF THE INVENTION

In the formation of precision wound packages of glass fiber strands the glass strand being wound is produced by attenuating a multiplicity of glass filaments from a glass fiber forming bushing, gathering the filaments into a strand after application of a suitable binder to the filaments and winding the wet strand onto a forming tube carried on the winder surface. The finished package is normally cylindrical in shape and should have a flat surface with flat edges on either end. U.S. Pat. Nos. 3,367,587 and 3,365,145 describe a process for producing a precision wound package of the type contemplated by the process of the instant invention.

In modern commercial fiber glass forming operations, the fiber glass bushings used are becoming much larger in size and consequently can process more pounds of glass at a given drawing speed than the smaller bushing of past years. A fiber glass bushing is typically a container fashioned of precious metal, preferably platinum or a platinum-rhodium alloy. The container is usually open at the top and is attached to a source of molten glass. The bottom of the bushing is provided with a plurality of orifices or tips which are in open communication with the molten glass in the container. Glass flows through the orifice or tips to form the glass filaments. The filaments are attenuated from the bushing by gathering them into a strand and winding them at high speeds.

With the advent of the larger bushings now available, i.e., having 2,000 orifices or tips and the availability of precision winders capable of winding glass strand at speeds of 3,000 feet per minute or more, problems are created which seriously effect the production of satisfactory packages by processes heretofore used. The high glass pull rates, i.e., the pounds of glass filaments pulled from the bushing per unit of time, usually reported per hour, resulting from attenuating 2,000 filaments or more at speeds of 3,000 feet per minute or higher places great stress on the traversing guides used to lay the strand on the package. These stresses usually produce traverse vehicle deformation as the vehicle reaches the edge of the package and returns and this results in a rounding of the package edge which is undesirable. Since the packages are wound during the fiber glass forming operation, and since the strand as wound contains a binder which is applied as the filaments are being drawn, the packages contain considerable quantities of water, 10 to 15 percent by weight being typical. These packages must be dried before shipment. With large packages weighing 30 to 70 pounds and having moisture contents of 10 percent by weight or more, it is found that the drying operation often results in packages that encounter difficulty in the pay out of the strand when used. Thus, in removing the strand from the finished package, the strand will often stick to an adjacent strand thereby interrupting the smooth linear removal of the strand desired by the user.

These difficulties encountered have been minimized greatly by virtue of the novel traversing guide system of the instant invention and the processing steps taken prior to winding the strand on the packages with that traversing system.

THE PRESENT INVENTION

Thus, in accordance with the instant invention fiber glass strand is wound during a forming operation by drawing filaments from a glass fiber forming bushing supplied continuously with molten glass. The glass fiber filaments are supplied with a suitable binder from an aqueous binder bath by drawing them over an applicator which places the binder on the filaments. The filaments are then passed through a drying zone to reduce the moisture content to 8 percent by weight or less. The dried filaments are then gathered into a strand and the strand is wound on a winder having a horizontal traversing guide vehicle and guide eye constructed such that the strand tension on the guide eye is opposed by the bending forces created by the traverse cam and vehicle guide to thereby reduce edge distortion in the package being wound. The finished package is removed and dried to completion in a drying oven.

The novel traversing guide system utilized to minimize edge deformation in the winding operation uses a high speed die set ball bushing running on a hardened steel shaft for lateral guidance. The strand guide is mounted on the guide which is linked to a cam roller and a cam. The strand guide and the cam roller are both positioned on the same side of the guide vehicle so that the bending moments created by the strand are opposed by the bending moments created by the traversing cam roller.

DETAILED DESCRIPTION OF THE INVENTION

For a more complete understanding of the instant invention and in particular to the traversing strand guide system employed, reference is made to the accompanying drawings in which.

Figure 1:
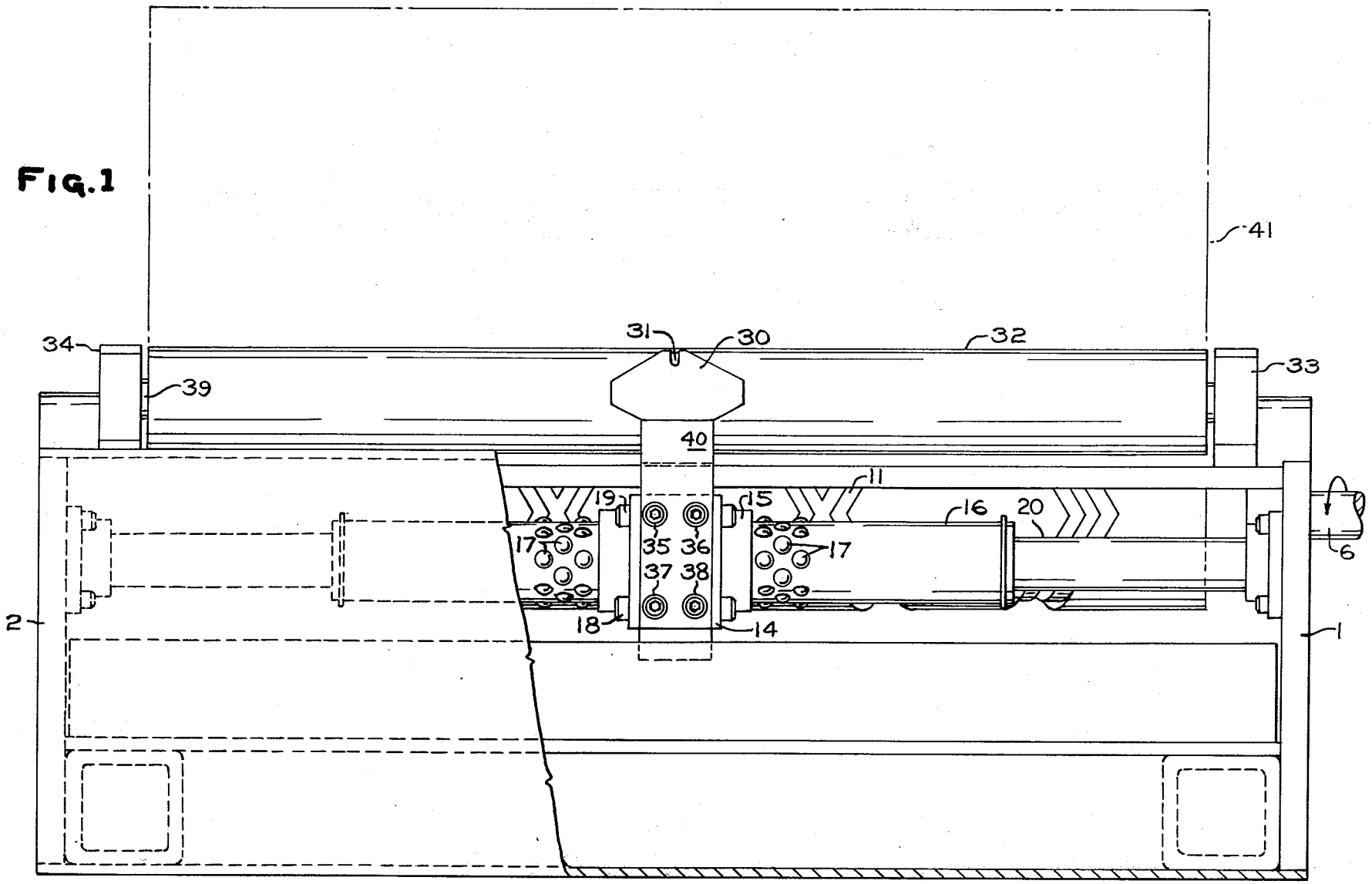
FIG. 1 is a top view of the traversing guide system of the instant invention.

Turning to the drawings and FIG. 1 in particular, there is shown therein in phantom lines a package 41 contained on a winder (not shown). Adjacent to the package 41 is a roller bail 32 which is mounted on a shaft 39 which is in turn held in place by the roller bail shaft supports 32 and 34. The roller bail 33 is freely rotatable by the frictional forces applied thereto when it is placed adjacent the package 41 during its rotation.

Behind the roller bail 32 and positioned above it is a guide 30 provided with a strand guide slot 31. The guide 30 is carried on plate 40 which is bolted through bolts 35, 36, 37 and 38 to housing 14. Housing 14 contains on its interior stationary shaft 20 which is covered over approximately one half of its length by a bushing 16. Bushing 16 is provided with a plurality of ball bearings 17 which protrude from the upper surface and on the interior are in touching relationship with the shaft 20. Covering a portion of the ball bushing 16 and rigidly mounted in the housing 14 is a bushing 15 which moves the vehicle or housing 14 over the ball bearings 17 of the ball bushing 16.

The housing 14 has a guide support pin 13 projecting from the underside thereof to which is attached a cam roller 12 and guide shoe 21. The roller 12 and guide shoe 21 ride in grooves 11 of cam 5 to provide lateral movement to the guide vehicle 14 as the cam 5 is rotated. Cam 5 is mounted on and rotatable with a rotating shaft 6 mounted on a bearing retainer 8 held in place by bolts 10 and 9 and containing a suitable bearing (not shown) therein. A similar bearing retainer mounting is placed on the opposite side of shaft 6 to maintain it in horizontal alignment.

In operation, the package 41 is rotated by the winder motor (not shown) in a clockwise direction. The roller bail 32 contacting the package rotates freely on shaft 39 in a counterclockwise direction. The rotation of the winder is coupled through gearing or belts (not shown) to the shaft 6 of the cam 5 and the cam 5 rotates. The rotation of shaft 6 causes the cam roller and shoe 21 to move in the grooves 11 of cam 5 and move the vehicle guide 14 laterally back and forth above the ball bushing 16. The bushing 16 moves in a lateral direction on fixed shaft 20. The vehicle 14 reverses direction when it reaches the end of the cam 5 and is forced to return by the cam grooves 11. By virtue of this vehicle traversing system, the vehicle guide 14 and guide eye 31 move the entire width of the package being wound while the ball bushing 16 travels only one half the length of the shaft 20 on which it is mounted.

In conventional precision transverse systems the cam roller and strand guide are mounted on opposite sides of the vehicle. This results in providing a bending moment which is the sum of the induced moments created by the traverse cam and the strand tension in the strand guide. With the instant invention, by placing the strand guide and cam roller on the same side of the vehicle, the bending moments induced by the traverse cam and the strand tension in the strand guide act in opposite directions thus reducing the tendency to create distortion of the strand vehicle and of the strand on the ends of the package.

The drying of strand which takes place during the process of the instant invention takes place prior to gathering the filaments into strand form. Thus, the filaments are passed at drawing speeds through an oven. The dryers employed may be electric heaters, gas fired ovens or dielectric dryers. Typically, the temperature of the oven is adjusted to remove the requisite quantity of water from the filaments at a given drawing speed. In all operations it is important to provide a zone of sufficient length with high enough operating temperatures to insure that the strand removed therefrom have a moisture content of 8 percent by weight or less, preferably 2 to 6 percent. It has been found for example that, using an electrically heated oven three feet long by 14 inches wide, a fan of 2,000 filaments of K6.75 fibers can be dried from 12 percent moisture to less than 8 percent at drawing speeds of 3,000 feet per minute.

The following examples are illustrative of the process of the instant invention.

EXAMPLE 1

In a typical operation of the instant invention K6.75 fibers were drawn from a 2,000 tip glass fiber bushing at the rate of 3,000 feet per minute, representing a glass pull rate of 90 to 92 pounds per hour. The winder used carried a forming tube and the traverse system was arranged to provide a 10 inch diameter package 10 inches long. The finished package weight was 30 to 32 pounds.

The fan of filaments were passed over an applicator roll and binder was applied thereto from aqueous solution to provide on the filaments a water content of 12 to 15 percent. The fan of filaments was drawn through an electrically heated oven operating at 1500° F. and located immediately below the applicator. The oven was 14 inches wide by 3 feet long. The filaments were gathered into a single strand by a conventional gathering shoe and the strand was passed through the strand guide slot 31 of the strand guide 30. The strand was reciprocated across the surface of the package 41 by the guide vehicle 14 riding on the ball bushing 16 and ball bushing 16 moved laterally until each of its ends contacted the bushing 15 of the vehicle guide. The package produced had no rounding of the edges and presented flat surfaces at the ends and on the major surface of the package. The moisture content of the package removed from the winder was less than 8 percent by weight.

EXAMPLE 2

Figure 2:
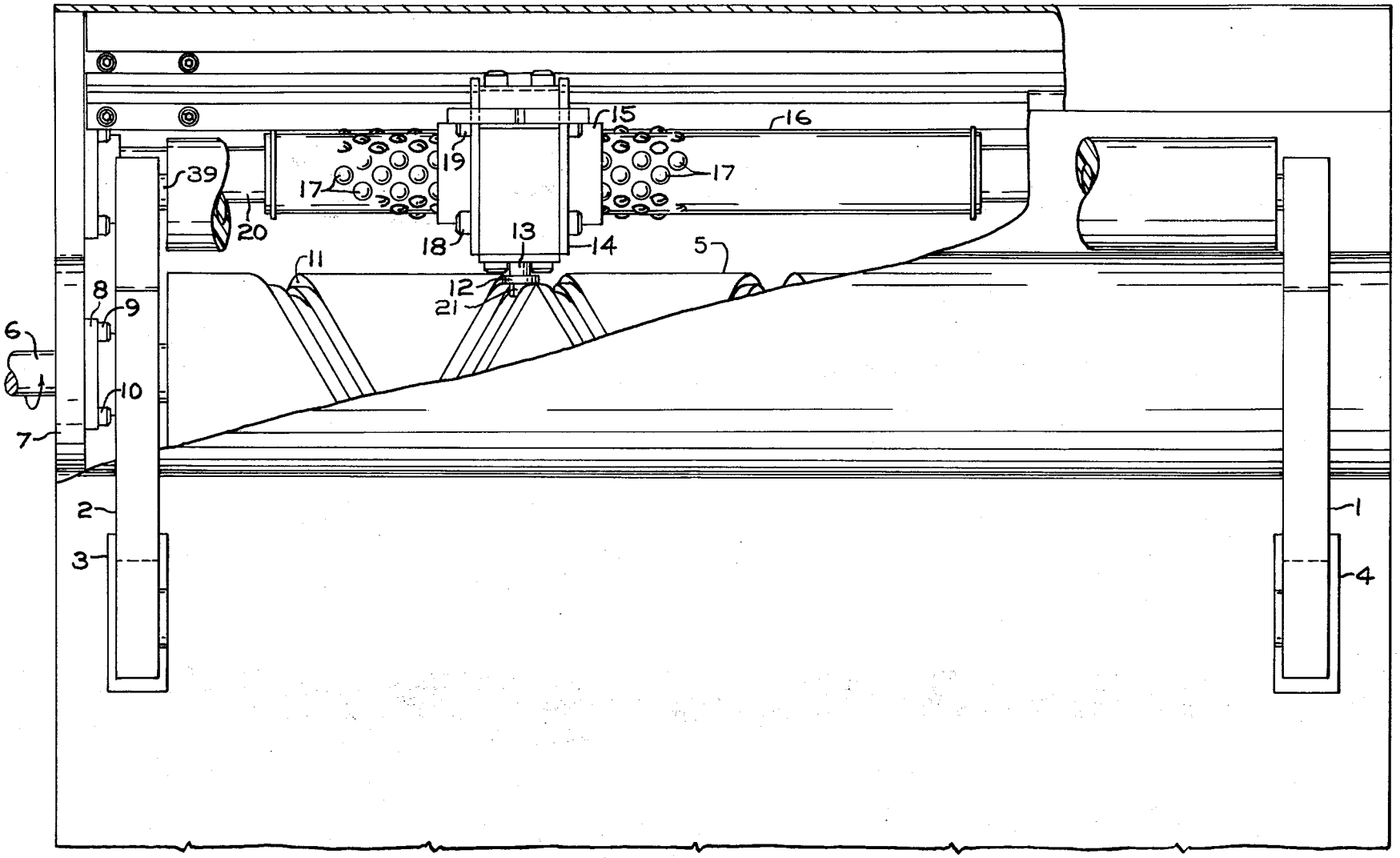
FIG. 2 is a front vertical view partially in section to show the internal structure of the traversing guide system of the instant invention.
Figure 3:
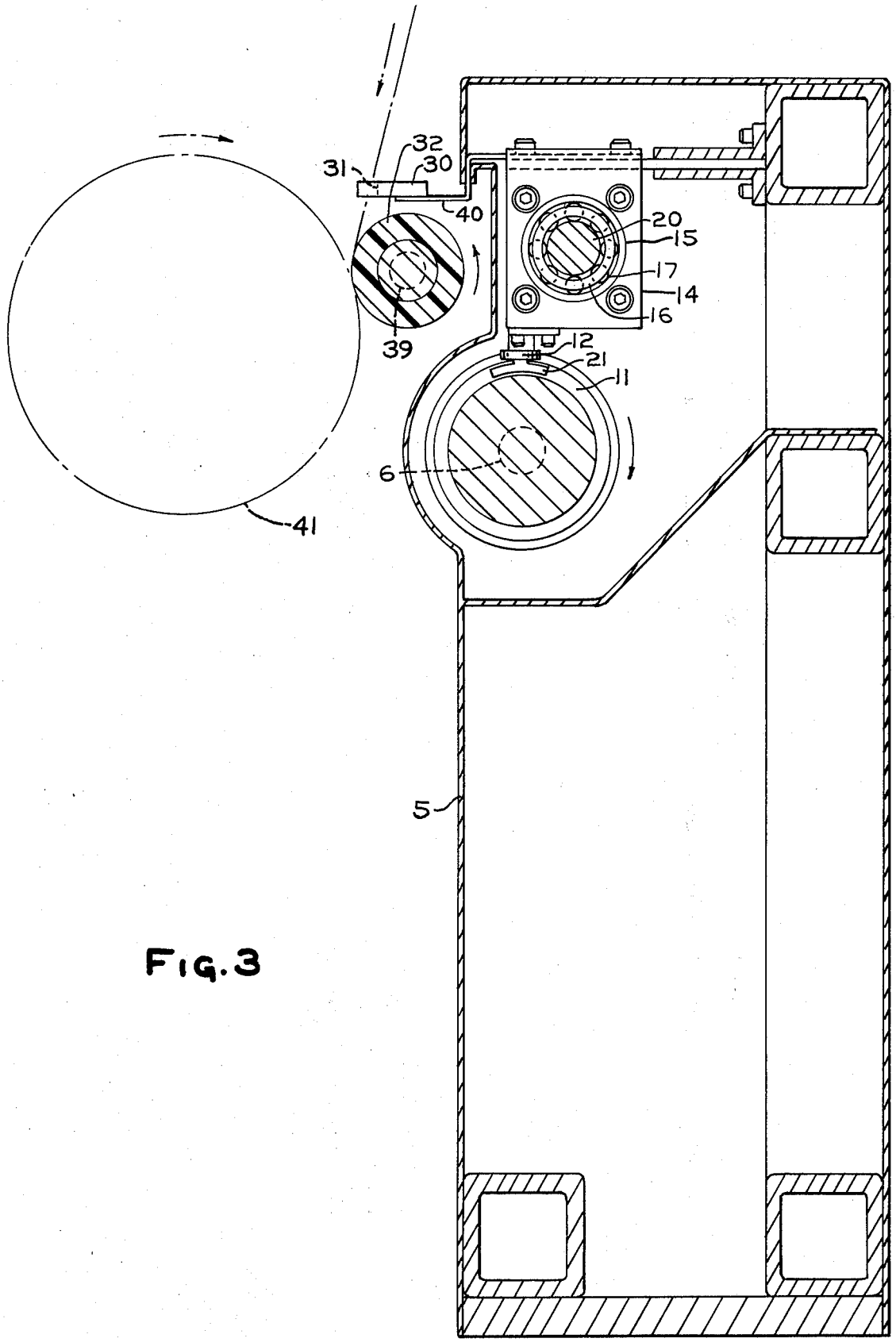
FIG. 3 is a side view in cross-section of the traversing guide system of the instant invention taken through the vehicle guide to show the internal structure of the ball bushing associated therewith.

In a similar operation using a 2,000 tip bushing supplied continuously with molten glass K6.75 filaments were drawn at 3,000 feet per minute representing a glass pull rate of 90 to 92 pounds per hour. The filaments were passed over an applicator which applied binder to them from an aqueous binder solution to provide filaments containing 12 to 15 percent by weight water thereon. The filament fan was passed through the same oven used in Example 1 at the same temperature. The filaments were gathered into a single strand using a conventional gathering shoe and wound on a package 12 inches long and 12 inches in diameter. The traverse guide system of FIGS. 1, 2 and 3 was used to lay the strand on the package. The finished package had a weight of 70 pounds and a water of less than 8 percent by weight. The ends of the package were flat with no rounding at the edges. The package was subsequently dried to less than 0.5 percent by weight water and tested for its ability to be unwound. The strand was removed from the package without any strand sticking occurring.

EXAMPLE 3

A 2,000 tip bushing continuously supplied with molten glass was used and 2,000 T2.5 filaments were drawn from the bushing at a drawing speed of 1,250 feet per minute representing a glass pull rate of 100 pounds per hour. The filaments were passed over an applicator roll and had a binder applied thereto from an aqueous binder bath. The filaments leaving the applicator contained 12 to 15 percent water by weight. The filaments were passed through the same oven as Example 1 at the same temperature. Upon emergence from the oven, the filaments were gathered into a single strand and wound on a package 12 inches long and 12 inches in diameter using the traversing guide system of FIGS. 1, 2 and 3 herein. A package weight of 70 pounds was realized and the strand on the package contained less than 8 percent water by weight. The ends of the package were flat and no rounding of the edges was observed. After subsequent drying to less than 0.5 percent water by weight, the package was found to be easily unwound without tangling or sticking of the strand.

While the invention has been described with reference to certain specific illustrative embodiments, it is not intended to be limited thereby except insofar as appears in the accompanying claims.

I claim:

1. An apparatus for traversing strand while it is being wound on a package comprising a rotating winder having a motor associated therewith, a roller bail associated with said winder and spaced therefrom said roller bail generally conforming on its long axis to the long axis of the winder surface, a traversing means connected to the motor, belt means associated with the motor to drive a rotating shaft on which the traversing mechanism is mounted, said traversing mechanism comprising a rotating shaft having affixed thereto a cam rotatable therewith, said cam being provided with longitudinal grooves on its external surface, a cam shoe constructed and arranged to ride in said grooves with an associated cam roller, a housing carrying a guide eye at one end on the external surface thereof which when in position, is located above the winder surface, a hardened steel shaft positioned within said housing, circumferentially disposed around said hardened steel shaft a ball bushing having a plurality of ball bearings mounted in the walls thereof and free rolling thereon, said ball bushing being capable of moving in a lateral direction along said steel shaft and said housing being capable of riding in a horizontal direction over the ball bearings contained on the exterior surface of said ball bushing, means to support the roller bail in operative relationship with the winding package during winding, means to reciprocate laterally the traversing housing through the cam and cam roller by rotation of the rotating shaft and cam when the winder motor is activated.

2. An apparatus for traversing strand while it is being wound on a package comprising a rotating winder having a motor associated therewith, roller means associated with said winder and spaced therefrom, said roller means generally conforming on its long axis to the long axis of the winder surface, a traversing means connected to the motor, means associated with the motor to drive a rotating shaft on which the traversing mechanism is mounted, said traversing mechanism comprising a rotating shaft having affixed thereto a cam rotatable therewith, said cam being provided with longitudinal grooves on its external surface, a cam shoe constructed and arranged to ride in said grooves with an associated cam roller, a housing carrying a guide eye at one end on the external surface thereof which, when in position, is located above the winder surface, a shaft positioned within said housing, bushing means having bearings circumferentially disposed around said shaft for moving in a lateral direction along said shaft and said housing riding in a horizontal direction over said bushing means, means to support the roller means in operative relationship with the winding package during winding, means to reciprocate laterally the traversing housing through the cam and cam roller by rotation of the rotating shaft and cam when the winder motor is actuated.

3. The apparatus of claim 2 wherein said roller means is a roller bail.

4. The apparatus of claim 2 wherein said means associated with the motor is a belt means.

5. The apparatus of claim 2 wherein said means associated with the motor is a gear means.

6. The apparatus of claim 2 wherein said shaft positioned within said housing is a hardened steel shaft.

7. The apparatus of claim 2 wherein said bushing means is a ball bushing having a plurality of ball bearings mounted in the walls thereof.

8. The apparatus of claim 7 wherein said ball bearings are mounted to freely roll on said shaft around which said bushing is circumferentially disposed.

* * * * *